US010307815B2

(12) United States Patent
Badent et al.

(10) Patent No.: US 10,307,815 B2
(45) Date of Patent: Jun. 4, 2019

(54) APPARATUS AND TOOL FOR ATTACHING A JOINING OR FUNCTIONAL ELEMENT TO A COMPONENT SECTION

(71) Applicant: TOX PRESSOTECHNIK GMBH & CO. KG, Weingarten (DE)

(72) Inventors: Michael Badent, Weingarten (DE); Roland Wendt, Argenbuehl (DE)

(73) Assignee: Tox Pressotechnik GmbH & Co. KG, Weingarten (DE)

( * ) Notice: Subject to any disclaimer, the term of this patent is extended or adjusted under 35 U.S.C. 154(b) by 154 days.

(21) Appl. No.: 15/233,080

(22) Filed: Aug. 10, 2016

(65) Prior Publication Data

US 2016/0346829 A1 Dec. 1, 2016

Related U.S. Application Data

(63) Continuation of application No. PCT/EP2014/078591, filed on Dec. 18, 2014.

(30) Foreign Application Priority Data

Feb. 26, 2014 (DE) ..... 10 2014 002 571

(51) Int. Cl.
*B21J 15/32* (2006.01)
*B21J 15/02* (2006.01)

(52) U.S. Cl.
CPC ..... *B21J 15/32* (2013.01); *B21J 15/025* (2013.01)

(58) Field of Classification Search
CPC ..... B21J 15/32; B21J 15/025
See application file for complete search history.

(56) References Cited

U.S. PATENT DOCUMENTS 2,570,296 A * 10/1951 Weiss ..... B21J 15/50 29/267
3,057,231 A * 10/1962 Ikelheimer ..... B21J 15/025 227/54

(Continued)

FOREIGN PATENT DOCUMENTS

CH 669 140 A5 2/1989
DE 42 11 276 A1 10/1993

(Continued)

OTHER PUBLICATIONS

English translation of International Preliminary Report on Patentability (Chapter I) (Application No. PCT/EP2014/078591) dated Aug. 30, 2016, 9 pages.

(Continued)

*Primary Examiner* — Ryan J. Walters
(74) *Attorney, Agent, or Firm* — Burr & Brown, PLLC

(57) ABSTRACT

An apparatus for attaching a joining element or functional element to a component section, wherein the apparatus is provided for a tool for attaching a joining element or functional element to a component section with a punch which is movable forward in a linear manner and is movable back again, wherein, during its forward movement, the punch entrains a joining element or functional element out of the presentation position on the apparatus and slides it into a guide line of the apparatus. According to the present invention, at least two positioning strips are present which extend along the guide line, wherein the at least two positioning strips reach into the region of the presentation position such that the positioning strips are present laterally next to a joining element or functional element which is situated in the presentation position.

14 Claims, 5 Drawing Sheets

(56) References Cited

U.S. PATENT DOCUMENTS

| | | | | |
|---|---|---|---|---|
| 5,636,426 | A | 6/1997 | Luckhardt et al. | |
| 5,733,089 | A | 3/1998 | Albright | |
| 6,571,463 | B2 * | 6/2003 | Coonrod | B21J 15/025 227/99 |
| 6,968,939 | B1 | 11/2005 | Mauer et al. | |
| 2010/0163595 | A1 | 7/2010 | Draht | |
| 2011/0290847 | A1 | 12/2011 | Drant et al. | |

FOREIGN PATENT DOCUMENTS

| | | | |
|---|---|---|---|
| DE | 297 19 744 | U1 | 2/1998 |
| DE | 10 2008 018 428 | A1 | 10/2008 |
| DE | 10 2008 051 488 | A1 | 4/2010 |
| EP | 0 922 538 | A2 | 6/1999 |
| WO | 94/15736 | A1 | 7/1994 |
| WO | 01/97999 | A2 | 12/2001 |

OTHER PUBLICATIONS

German Search Report (Application No. 10 2014 002 571.3) dated Oct. 9, 2014.
International Search Report and Written Opinion (Application No. PCT/EP2014/078591) dated Feb. 12, 2015.
European Office Action, European Application No. 14815725.8, dated Oct. 18, 2018 (5 pages).

* cited by examiner

APPARATUS AND TOOL FOR ATTACHING A JOINING OR FUNCTIONAL ELEMENT TO A COMPONENT SECTION

CROSS REFERENCE TO RELATED APPLICATIONS

This application is a continuation of International Application No. PCT/EP2014/078591 filed Dec. 18, 2014, which designated the United States, and claims the benefit under 35 USC § 119(a)-(d) of German Application No. 10 2014 002 571.3 filed Feb. 26, 2014, the entireties of which are incorporated herein by reference.

FIELD OF THE INVENTION

The present invention relates to an apparatus and tool for attaching a joining or functional element to a component section.

BACKGROUND OF THE INVENTION

Apparatuses or tools for attaching joining elements and/or functional elements to components are known, for example, setting tool heads or setting or riveting tools.

Functional elements or joining elements such as, for example, half-hollow self-pierce rivets, full punch rivets or clinch rivets, are able to be processed using such apparatuses or tools.

The joining elements or functional elements provided for a join to the component are moved, prior to the attaching of the same to the component, by way of a linearly movable punch from a presentation position of the apparatus to the component and there are attached under the effect of force.

Elements which are attached to at least one material or sheet-metal layer or which are used for joining, in particular, two or more material layers such as, for example, metal or sheet-metal layers, are to be understood as joining elements, a joining operation taking place when the joining element is attached. All types of rivet elements are deemed to be joining elements. Functional elements are deemed to be elements which are attached to at least one material layer in order to provide a function and/or form on the material layer such as, for example, a stud section, thread section and/or ball section or a different functionality and/or form.

A combination of a joining element and a functional element in one element is possible.

SUMMARY OF THE INVENTION

It is the object of the present invention to improve the apparatuses or tools named in the introduction with regard to a long service life, in particular, to avoid malfunctions produced by tilting or tipping joining or functional elements which are presented in the apparatus or in the tool and are forwarded.

The present invention proceeds from an apparatus for attaching a joining element or a functional element to a component section, wherein the apparatus for a tool for attaching a joining element or functional element to a component section is provided with a punch which is movable forward in a linear manner from a moved-back position on the tool and is movable back again, wherein a joining element or functional element is movable by means of a feed line to a presentation position in a presentation region at the end face in front of the moved-back punch such that, during its forward movement, the punch entrains a joining element or functional element out of the presentation region on the apparatus and slides it into a guide line of the apparatus. The guide line connects, in particular, to the presentation position or is adjacent the presentation position and runs from the presentation position e.g. transversely with respect to the feed line in the direction of a die unit of the tool, on which the component section is supported for an attaching operation.

A first substantial aspect of the present invention is that there are present at least two positioning strips which extend along the guide line and are realized for positioning a joining element or a functional element during the sliding movement through the guide line, wherein the at least two positioning strips reach out of the guide line into the presentation region such that the positioning strips are present laterally next to a joining element or functional element which is situated in the presentation position. This creates a compactly structured and reliable apparatus that is not susceptible to faults. A joining or functional element tilting or jamming in the presentation region and adjacent regions is avoided.

In particular, each positioning strip is a single piece. The positioning strips reach into the guide line over almost the entire or substantial length thereof and extend as far as into or onto the presentation region. In this case, the ends of the positioning strips extending in the direction of the punch, with the joining or functional element in the presentation position, are advantageously at a spacing laterally to the joining or functional element of approximately, for example, a few fractions of a millimeter.

The at least two positioning strips extend over a substantial section of the guide line, are accommodated in the guide line and protrude beyond a bottom edge of a feed channel of the feed line by way of an upper portion. From the bottom edge of the feed channel, the protrusion of the positioning strips, with reference to a height of the feed channel, is advantageously in particular 50, 60, 70, 80, 90 or 100 percent.

The positioning strips, coming from the guide line accordingly project comparatively far beyond the bottom edge of the feed line, in particular, over the entire height of the presentation region, the positioning strips being present laterally of a joining or functional element that has been presented in the presentation position. In this case, the positioning strips, which extend upward onto the presentation region, are present laterally in an extension of the feed channel in such a manner that a joining or functional element arriving from the feed channel is not able to knock against the positioning strips or is not able to tilt thereon. As differently dimensioned joining or functional elements are processable by the apparatus, the positioning strips are correspondingly matched to the feed line, where applicable separately for each dimension of the joining or functional elements to be processed.

In an advantageous manner, the positioning strips extend in the direction of displacement of the punch as far as at least almost into a region approximately below an end face of the moved-back punch which acts on a joining or functional element. Radially to the direction of displacement of the punch, the positioning strips or the inside surfaces thereof are present laterally offset to a volume which is assumable by the punch when the moved-back punch is moved forward.

The feed line is present below the presentation region or in front of the presentation region in the direction of displacement of the punch. The guide line connects to a joining or functional element held in the presentation position in the presentation region below or in the direction of displacement of the punch. It is necessary to distinguish between the presentation region and the guide line, where applicable, the associated component sections are to be viewed in a differentiated manner for each joining or functional element dimensioning.

The apparatus according to the present invention includes, in particular, a guideline with a component which surrounds the guide line, for example, a hold-down clamp with the positioning strips, a feed section by means of which the joining or functional elements are received by the feed line and move to the presentation position, and components in the region of the presentation position, for example, with a stop component against which the joining element or functional element docks in the presentation position. The apparatus can be realized, for example, as an attachment part on a tool, e.g. a riveting tool for an attachment, such that the apparatus according to the present invention is integrated on a rivet setting head of the tool. By way of the apparatus according to the present invention, when it is matched correspondingly to a relevant tool, conventional tools, where applicable, are able to be upgraded or modified with a punch.

With the present invention, to date regularly critical operating phases when forwarding a joining or functional element out of the presentation position into the guideline are advantageously countered. With the assistance of the positioning strips, the moving joining or functional element is, in particular, not able to jam or tilt in an undefined manner or, as a result of a lack of holding contact in the tool, slip or fall forward. In particular, a holding contact for the joining or functional element with the positioning strips is already set up briefly prior to or directly after leaving the presentation position. For example, a joining or functional element, which is held in a defined or aligned manner in the presentation position, can already be acted upon or held and positioned by the positioning strips after being moved out of the presentation position by a few tenths of a millimeter. In this case, the joining or functional element is forwarded in a defined manner into the and along the guideline as a result of the further punch movement. The joining or functional element, in this case, is forwarded or guided along the positioning strips in a defined aligned manner, in particular, continuously or without interruption in the contact situation.

It is advantageous when the positioning strips extend beyond the guide line into the presentation region in such a manner that a joining element or a functional element comes into contact with the positioning strips when moving out of the presentation position on the path into the guide line and is held in a defined manner between the positioning strips. The defined holding of the joining or functional element by the positioning strips continues to be effected through the guide line in particular at every point or continuously along the path of the joining or functional element out of the presentation position.

A joining or functional element which is held between the positioning strips is advantageously centered directly in the guide line over the entire length of the displacement movement.

The positioning strips act as mechanical holding means for joining or functional elements with no critical interference contour along the path of movement of the joining element. The positioning strips not only provide a holding force for retaining the joining or functional element but urge, if necessary, the joining or functional element into the correct alignment together with the driving and aligning action of the punch.

It is also advantageous that the positioning strips, which protrude in the direction of the presentation position on the guide line, exert a guiding and/or aligning function on a joining or functional element which emerges out of the feed line along the final part path when feeding into the presentation position. To this end, the relevant end section of the positioning strips can be vertical laterally on the feed line in the direction transversely to the feed line and form a delimiting wall on the outside for an introduced joining or functional element such that it passes in a functionally correct manner into the holding position and is held there by holding mechanisms of the presentation position. The corresponding end sections of the positioning strips can be matched to the outside form of the relevant section of the joining or functional element.

In an advantageous manner, an end-face end of the punch which acts on the joining or functional element comprises a maximum external dimension which is the same as or somewhat smaller than a maximum external dimension or a maximum diameter of the joining or functional element. The joining or functional element, as a rule, comprises a head section which has a larger diameter than a shaft section of the joining or functional element, the head section or the top surface of the head thereof facing the punch in the presentation position. Using the matched punch, a joining or functional element, which is slid along the positioning strips in front of the punch, is able to abut against the positioning strips by way of part of an edge of the head section. The positioning strips, which act on the outside of the joining or functional element, for example, oppositely located or symmetrically with respect to the longitudinal axis of the joining or functional element, in this case, hold the joining or functional element, which is present between the positioning strips, in a clamping manner, but only to the extent that the joining or functional element is able to be slid through between the positioning strips. The positioning strips, in this case, are urged somewhat outwardly. Accordingly, the positioning strips are advantageously mounted so as to be deflectable or prestressed somewhat against a spring force radially with respect to the longitudinal axis of the guide line.

In a preferred manner, the at least two positioning strips are themselves identical. It is additionally advantageous when there are precisely two positioning strips, in particular, located opposite one another with a void volume of a guide channel of the guide line present in between them.

A further substantial aspect of the invention is that the guide line includes sections of a bore wall of a guide bore in a guide basic body and at least two positioning strips present along the guide line which are realized for positioning a joining or functional element when it is slid through the guide line, wherein the positioning strips are matched to the bore wall such that a joining or functional element is able to reach the sections of the bore wall as it slides through the guide line. The positioning strips are received or mounted, in particular, on the guide basic body and project radially inward somewhat beyond the bore wall. A joining or functional element is then able to reach the bore wall, contacting it by way of its outside surface, in particular when the bore wall and the inside surfaces of the positioning strips are in extensive alignment with one another, the inside surfaces of the positioning strips being in holding contact with the joining or functional element or being urged somewhat outward. In a basic state of the apparatus when no joining or functional element is present, the inside surfaces of the positioning strips, which are realized to abut against the joining or functional element, protrude somewhat or, for example, a few tenths of a millimeter, radially inward beyond the bore wall. A joining or functional element, which is held in the position of the positioning strips between the same, when being slid through the guide line, remains, as a rule, at a spacing from sections of the bore wall which are extensively adjacent the positioning strips. The bore wall is in particular matched to a maximum diameter of the joining or functional elements, a plurality of joining or functional elements that are dimensioned with different maximum diameters, where applicable, being processable with the apparatus. The maximum diameter of the joining or functional elements for problem-free processing of the joining or functional elements must simply be within a diameter range admissible for the apparatus, the different maximum diameters of the joining or functional elements being conditional, for example, on tolerances. The positioning strips are received in a preferred manner in receiving volumes or recesses in the bore wall which are correspondingly matched to the positioning strips, e.g. by the bore wall being interrupted extensively over its substantial length by means of at least two recesses. The recesses can be formed, for example, by longitudinal grooves which extend parallel to the bore and have, for example, angular sides in the bore wall. The recesses enable a comparatively small adjusting movement which is radial to the longitudinal axis of the guide line and a small adjustment of the positioning strips obliquely with respect to the longitudinal axis of the guide line.

In practice, when being slid through the guide line, a joining or functional element is in abutment against the positioning strips, it being possible, in particular, for there to be short-term contact between the joining or functional element and sections of the bore wall which are present extensively between the positioning strips. In this case, the positioning strips yield radially outward.

In an advantageous manner, the relevant sections of the bore wall can take over positioning and/or guiding tasks for the joining or functional element when it is slid through the guide line.

When observed theoretically, proceeding from substantially cylindrical designs of the participating elements, an arrangement is conceivable in which a maximum external diameter of the joining or functional element corresponds exactly to the diameter of the bore wall and the inside surfaces of the positioning strips, which abut against the joining or functional element in a holding manner, comprise the form of a segment of a circular arc with the radius of the bore wall such that when the joining or functional element, which has the same joining or functional element head external diameter, slides through the guide line, the inside surfaces of the positioning strips are urged outward precisely as far as the diameter of the bore wall, over the entire extent of the external diameter of the joining or functional element, for example an edge of the head of the joining or functional element, in an idealized manner there being touching contact between the inside surfaces of the positioning strips and the sections of the bore wall located in between. In reality, however, deviations from the state occur, for example in the case of a smaller external diameter of the head of the joining or functional element or of the punch or on account of deviations from the cylindrical form and/or on account of tolerances of the relevant parts.

In the case of a punch external diameter which is identical to the diameter of the joining or functional element, in the idealized or theoretical case, sections on the associated circumference of the head of the joining or functional element abut against the inside surfaces of the positioning strips and also corresponding sections on the outside circumference of the punch. In an advantageous manner, the punch diameter is somewhat smaller than the diameter of the joining or functional element.

A comparatively very small air ring gap with a radial extension of, for example, a few tenths of a millimeter, remains with respect to slightly radially outwardly offset sections of the bore wall which are present extensively between the positioning strips. If the joining or functional element is tipped or radially offset, in particular, for a short time and in the smallest manner when sliding through the guide line, the joining or functional element is also able to contact the relevant sections of the bore wall for a short time.

The passage or the void volume provided by the guide line, into which the punch dips when moving forward and through which the joining or functional element is slid, is delimited by the sections of the bore wall and the inside surfaces of the at least two guide strips.

It is further advantageous that at least one of the at least two positioning strips is pivotable about a pivot axis in the region of the presentation region. In particular, two or three positioning strips which are both pivotable are present. The pivotability or longitudinal adjustment of the positioning strips is possible, in particular, by a maximum of a few angular degrees, for example by a maximum of 1, 2, 3 or 4 angular degrees. The pivot axes extend, in particular, transversely or obliquely with respect to the direction of displacement through the guide line or transversely with respect to the longitudinal axis of the positioning strips. The pivot axes of the, for example, two positioning strips are, in a preferred manner, at the height of the presentation region, laterally offset with respect to a volume which is occupied by the punch moving forward out of the moved-back position, spaced somewhat in front of the end face of the moved-back punch or on both sides of a volume which is occupiable by a joining or functional element in the presentation position. In other words, the pivot axes are present parallel to the feed direction in the extension of respective, oppositely situated walls of the feed line. With the pivot bearing arrangement, the positioning strips are able to be adjusted in the guide line obliquely with respect to the longitudinal axis of the guide line.

In a preferred manner, the positioning strips are realized in the same manner or are pivotable. In particular, the at least two positioning strips are pivotable in each case about a pivot axis and the pivot axes are aligned parallel to one another and are located at the height of a cross section to the direction of movement of the punch. By way of the pivotability, as a joining or functional element slides through the guide line, the positioning strips are advantageously able to assume an alignment where they converge in the direction of displacement in a funnel-like or oblique manner through the conveying line. Thus it is always reliably ensured that a joining or functional element is held between the positioning strips during the entire displacement operation and, as a result of the constriction formed in the sliding direction, cannot fall forward.

In principle, as an alternative to this or in addition to it, a pivot bearing arrangement of the positioning strips can be provided in an end region of the positioning strips remote from the presentation position or at another place.

According to an advantageous modification of the present invention, the at least two positioning strips are mounted in a resilient manner in the presentation region. A spring bearing arrangement is present, for example, for this purpose. In particular, the resilient bearing arrangement is effected in the radial direction with respect to the movement direction of the punch or with respect to the longitudinal axis of the guide line. In particular, precisely one of the at least two positioning strips is mounted in a resilient manner or all the positioning strips are in each case mounted in a resilient manner in particular in the same way. In an advantageous manner, the spring loading is such that the positioning strips are prestressed in the basic state without a joining or functional element, in particular, aligned at least almost parallel to the punch axis, a prestressing force, if also, a comparatively small prestressing force, where applicable, acting on the positioning strips as a result of the spring force of corresponding spring bearing means of the spring bearing arrangement.

The type or realization of the resilient spring bearing arrangement of the positioning strips in the region of the holding position can be set up in the most varied of ways, for example, as a result of coil, spiral, leaf, ring or other springs. The force, which acts on the joining or functional element by means of the positioning strips on account of the spring force of the resilient bearing arrangement, is matched such that, on the one hand, there is no excessively high friction between the joining or functional element and the inside surface of the positioning strips when sliding through the guide line in order to minimize heat development, abrasion and wear, and, on the other hand, a sufficient holding force always acts on the joining or functional element such that in all possible spatial positions of the apparatus or of the tool, the joining or functional element is held between the positioning strips, even when used overhead, for example when the punch is pulled back in a special or malfunctioning operating state before the joining or functional element has left the guide line and is attached to the component section. In addition, it can safely be assumed after the malfunction when the operation is started up again that the joining or functional element is present inside the guideline in a functionally-correct alignment. For the holding function of the positioning strips on a joining or functional element acts in a purely mechanical manner and over the entire possible movement path of the joining or functional element which is covered by a joining or functional element inside the apparatus directly after leaving the presentation position. In the presentation position itself, other holding mechanisms act, as a rule, on the joining or functional element, for example, a holding force as a result of suction at a negative or differential pressure which acts on the joining or functional element.

A further advantageous variant of the present invention is characterized in that the at least two positioning strips are pivotable in the presentation region about a pivot axis which is mounted in particular in a resilient manner. The bearing arrangement is accordingly effected in the region of the punch-side ends of the at least two positioning strips. In an advantageous manner, the resilient bearing arrangement is supplemented or superimposed by a pivotable bearing arrangement. An ideal and reliable holding action with consideration to as little friction as possible on the joining and functional element over the entire length of the guide line is consequently realized advantageously in a space-saving and simple manner. For example, a cylindrical pin, which reaches through a suitable opening or bore in the positioning strip such that the positioning strip is pivotable or adjustable about the longitudinal axis of the pin, in particular, by a few angular degrees, can be provided as the bearing element of the pivot bearing arrangement. The pivot axis, which is providable by way of the pin, is in particular aligned transversely with respect to the longitudinal direction of the guide line, for example, in the direction of the approach through the feed line.

The pivot axis is resiliently mounted in particular radially to the longitudinal axis of the guideline or radially to the movement axis of the punch. For example, the pin of the pivot bearing arrangement is movable by means of a link such as, for example, a groove, a recess or an elongated hole, into which a section of the pin protruding on the positioning strip reaches, whereby the alignment and/or a length of the spring path in one direction is determined by the link. By way of the link, in particular, a radial movement path of the pin inward is delimited in a predefinable manner and consequently the radial movement path of the positioning strips inward is predefined, for example, by an end of the link.

In addition, it is advantageous that the longitudinal ends of the at least two positioning strips, which are located opposite the longitudinal ends in the presentation region, are received in a resilient manner in the radial direction to the longitudinal axis of the guide line. With the measure, a holding force is applied in a reliable and compact manner onto a joining or functional element which is slid through along the guide line, in particular, over the entire movement section through the guide line.

Where applicable, at least one resilient receiving means can also be provided at one position or several positions over the length of the positioning strips.

In particular the ends of the positioning strips, which are assigned to a free end of the guide line at which a joining or functional element leaves the guide line and is attachable to the component section, are acted upon by an elastic element which acts radially outward on the positioning strips and surrounds them, for example, in a ring-shaped manner, such as, for example, a coil spring which is realized in a ring-shaped manner, a toroidal spring and a rubber ring or O-ring seal. The elastic element can abut directly on the outside against the positioning strips or act indirectly on the positioning strips as a result of an intermediate element located in between.

The positioning strips are in particular resiliently mounted or prestressed in the region of the longitudinal ends which are assigned to the end of the guide line. The positioning strips are accordingly able to yield resiliently outward in the radial direction with respect to the longitudinal axis of the guide line when a slid-through joining or functional element forces the positioning strips below apart.

In addition, it is advantageous that the positioning strips extend over at least a substantial length of the guide line. Thus, a defined positioning of a joining or functional element which is slid through the guide line by way of the punch is set up with the positioning strips over the substantial or, where applicable, entire length of the guide line. The positioning strips protrude, in particular, on the punch side beyond the guide line, in particular, over the entire height of the feed line which arrives in a transverse manner, and are able to reach as far as a bottom free end of the guide line which faces a die unit of the tool.

It is additionally advantageous that the positioning strips and the guide basic body are matched to one another in such a manner that, with reference to an overall area of a cross section of the guide line, the at least two positioning strips form a proportion of the overall area of approximately 30%, in particular approximately 50%, in particular approximately 60% or more. The proportion of the overall area, which can be supplemented in each case to 100%, of approximately 70%, in particular approximately 50%, in particular, approximately 40% or less is formed by sections of the bore wall of the guide bore which are located extensively between the positioning strips. In an advantageous manner, precisely two oppositely situated or three positioning strips are present which in each case make up, for example, approximately between 10 and 20 or more percent of the overall area of a cross section of the guide line.

A further advantageous modification of the present invention is characterized in that the at least two positioning strips are present matched in such a manner so as to provide a holding force on the joining or functional element as soon as a joining or functional element moved out of the presentation position comes into contact with the positioning strips, wherein a holding force acts on the joining or functional element by way of the positioning strips along the entire path that is then coverable along the positioning strips by the joining or functional element. The positioning strips can be matched such that a joining or functional element held in the presentation position, for example, by means of suction, is not in contact with the positioning strips, which is applicable to all dimensions of the joining or functional element that are processable by the apparatus. The spacing between the joining or functional element in the presentation position and the positioning strips, however, is comparatively very small or is, for example, approximately a millimeter or a fraction of a millimeter. After a correspondingly short movement of the joining or functional element out of the presentation position as a result of moving the punch down and pressing a punch end face against an, in particular, flat top surface of a head of the joining or functional element, after the joining or functional element makes a brief movement out, an outside section of the joining or functional element comes into abutment with the positioning strips and, when reaching the positioning strips, is held in a clamping manner by the positioning strips. The presentation position of the joining or functional element remains defined even at this time. Consequently, the joining or functional element remains reliably held in the guide line even in the event of a malfunction, for example when the punch, moving forward, suddenly moves back again before reaching an extension end point, the joining or functional element therefore remaining in the guide line. The positioning strips are correspondingly realized for providing the holding force, in particular, by means of the prestressing or the spring bearing arrangement.

The holding force is in particular substantially smaller than a punching force which acts on the joining or functional element by the punch such that a joining or functional element is able to be slid easily through the guide line by a driven punch, but at the same time is clampingly held between the positioning strips.

In addition, it is advantageous that the positioning strips are developed with a contact side matched to an outside form of a joining or functional element. The contact side is formed by an inside surface of the positioning strip, the inside surface adjoining a passage volume which is provided by the guide line for the joining or functional element to slide through. The contact side is matched, for example, to an outside form of a region of the joining or functional element with the largest diameter, for example, a head section of the joining or functional element. A plurality of commercially available joining or functional elements comprise a cylindrical basic form in particular also in the region of the largest outside or radial dimension such that the contact side is formed in the same radius in a correspondingly concave manner or corresponding to a segment of a hollow cylinder. The contact side can abut advantageously over a large surface, by means of line contact or at least by means of several contact points on the outside of the joining or functional element or can press against the outside of the joining or functional element.

The positioning strips can be formed advantageously in each case as strip-shaped half-shells with an inside surface which is formed with a concave radius.

In an advantageous manner, the two or more positioning strips are positioned extensively evenly relative to one another with reference to cross sections of the guide line, for example, subject to two positioning strips located opposite one another in the guideline or subject to three positioning strips offset extensively in each case by 120 angular degrees.

In addition, it is advantageous that a leaf spring arrangement for the resilient bearing arrangement of the at least two positioning strips is present in the presentation region. Leaf springs are realizable in a simple and space-saving manner and are additionally functionally reliable.

In principle, it is conceivable to receive the positioning strips on the free end or on an end on which the joining or functional element is ejected by the extended punch by means of a resiliently mounted pivot axis and to receive or prestress the positioning strips in the region of the presentation position simply by means of a radially acting spring bearing arrangement.

In addition, it is advantageous that a differential pressure arrangement is present, by way of which a pressure difference is generatable in the region of a joining or functional element presented in the presentation position such that the joining or functional element is held at the acting differential pressure in a positionally-fixed manner in the presentation position. In an advantageous manner, a negative pressure arrangement is realized in particular for applying a negative pressure in the region of the presentation position for holding a joining or functional element situated in the presentation position in a positionally-fixed manner. If the joining or functional element is held in the presentation position as a result of the negative pressure or suction and is moved slightly out of the presentation position by the punch, the vacuum effect on the joining or functional element breaks down, the joining or functional element already being in holding contact at the moment with the positioning strips which abut against the outside of the joining or functional element.

The present invention additionally relates to a tool for attaching a joining or functional element to a component section by means of a punch which is movable forward in a linear manner out of a moved-back position on the tool and is movable back again, wherein an apparatus according to one of the above-named variants is present.

The advantages explained above are consequently able to be realized, for example, on a riveting tool.

The tool can be realized, for example, as a half-hollow self-pierce riveting tool, a solid punch riveting tool or a clinch riveting tool or as a tool by way of which other joining elements and/or functional elements are able to be introduced into one sheet-metal layer or several sheet-metal layers.

The tool additionally includes in particular in an advantageous manner sensor means and a control unit, in particular with a computer unit for processing sensor data of the sensor means or for controlling the operational procedures, for example a drive unit which is also assigned to the tool, such as a hydraulic, pneumatic, hydro-pneumatic and/or electric drive for the linear movement of the punch or for other driven functional parts.

BRIEF DESCRIPTION OF THE DRAWINGS

Further features and advantages of the present invention are explained in more detail by way of the exemplary embodiment of a tool according to the present invention shown in the figures.

DETAILED DESCRIPTION OF THE INVENTION

The figures show sectioned and schematic representations of part of a tool which is realized according to the present invention as a riveting tool 1 with a feeder 6 for joining elements for attaching a joining element to a component section B which is indicated by the broken line. The component section B consists, for example, of two or more layers of sheet-metal material which are to be joined together. If, as an alternative to the joining element, a functional element is to be processed, the functional element is as a rule attached to precisely one sheet. The functional element can, however, also be designed in order to be able to be attached to several sheet-metal layers, where applicable with the additional function of joining several sheet-metal layers.

Figure 1:
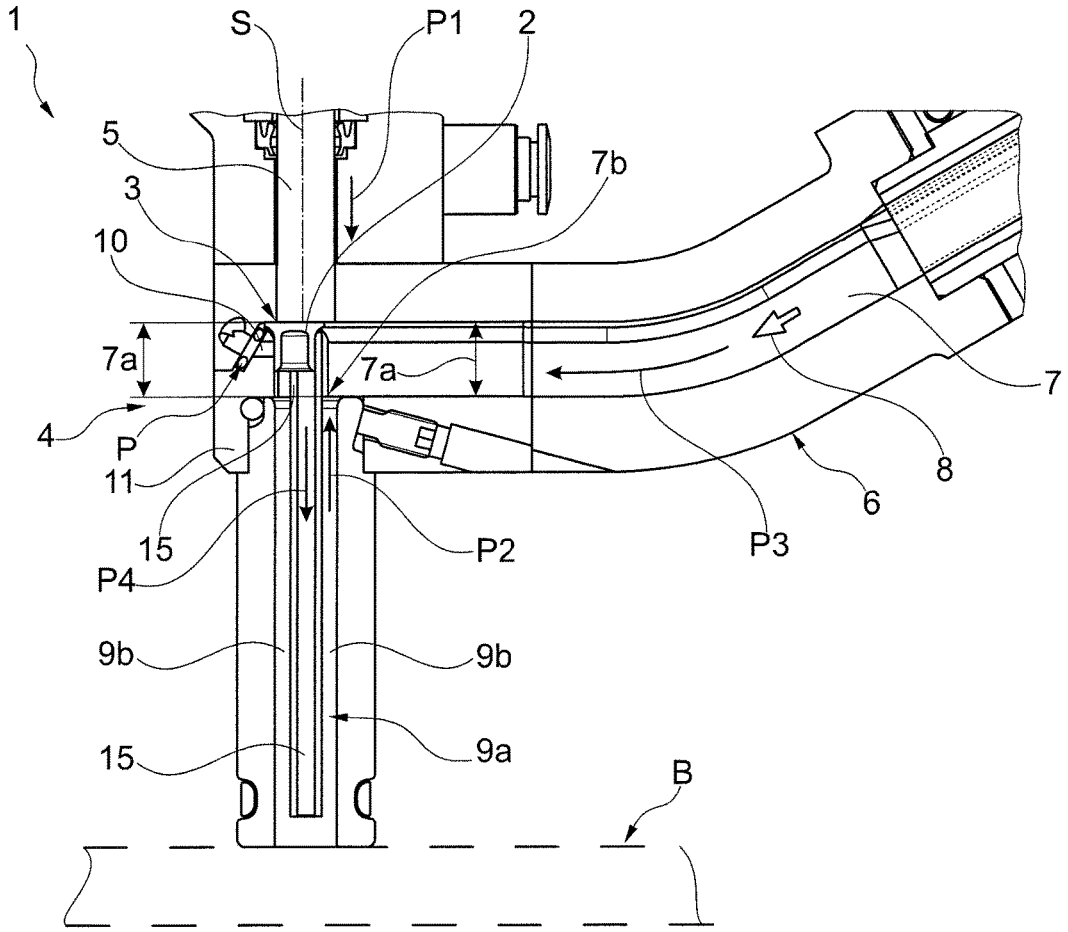
FIG. 1 shows a sectional representation of part of a tool according to the invention with a joining element presented in front of a moved-back punch and a feed line for joining elements connected thereto.
Figure 2:
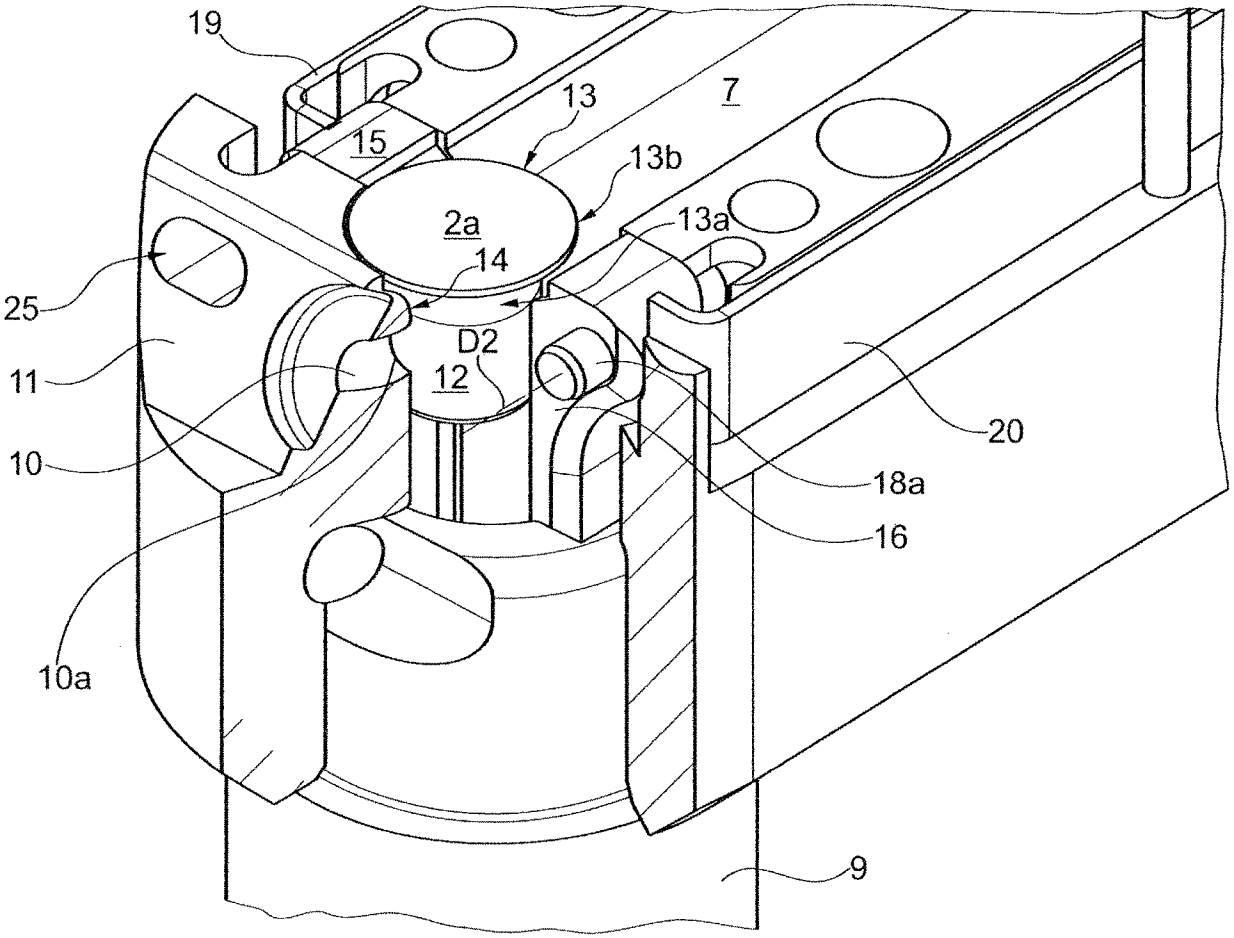
FIG. 2 shows a partially sectioned perspective cutout of part of the tool according to FIG. 1.
Figure 3:
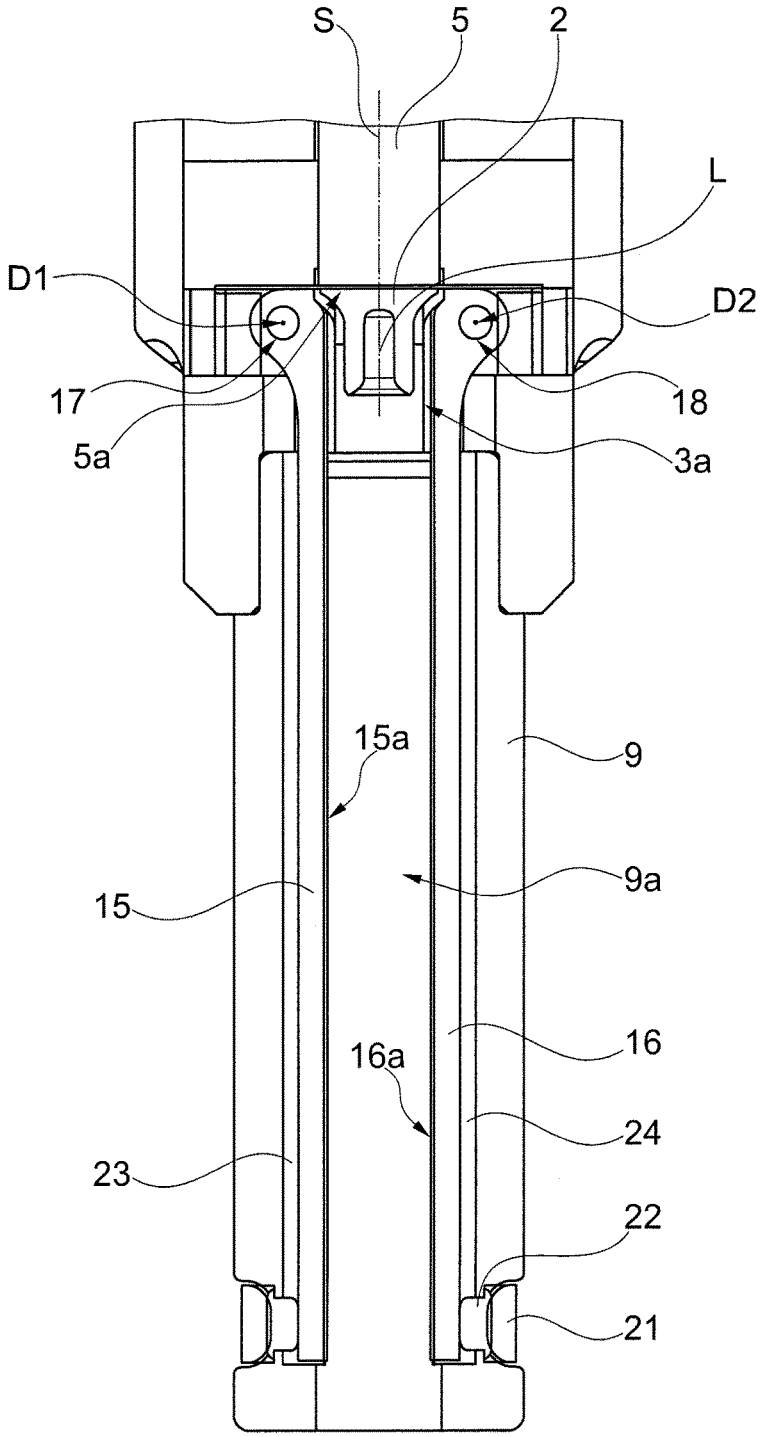
FIG. 3 shows a sectional representation of the arrangement according to FIG. 1 offset in relation to the section according to FIG. 1 by 90 angular degrees.

According to FIGS. 1 to 3, a joining element, which is presented individually in the riveting tool 1, is shown here, as an example, as a half-hollow self-pierce rivet 2 which is processable by the riveting tool 1 or is pressable into the component section B with the application of force and the partial deformation of the half-hollow self-pierce rivet 2 and of the component section B. The half-hollow self-pierce rivet 2 is held in FIGS. 1 to 3 in a positionally-fixed manner in a waiting or presentation position 3 in the riveting tool 1. In the presentation position 3, the half-hollow self-pierce rivet 2 is present in a presentation region 3*a* or occupies the presentation region 3*a*.

Figure 4:
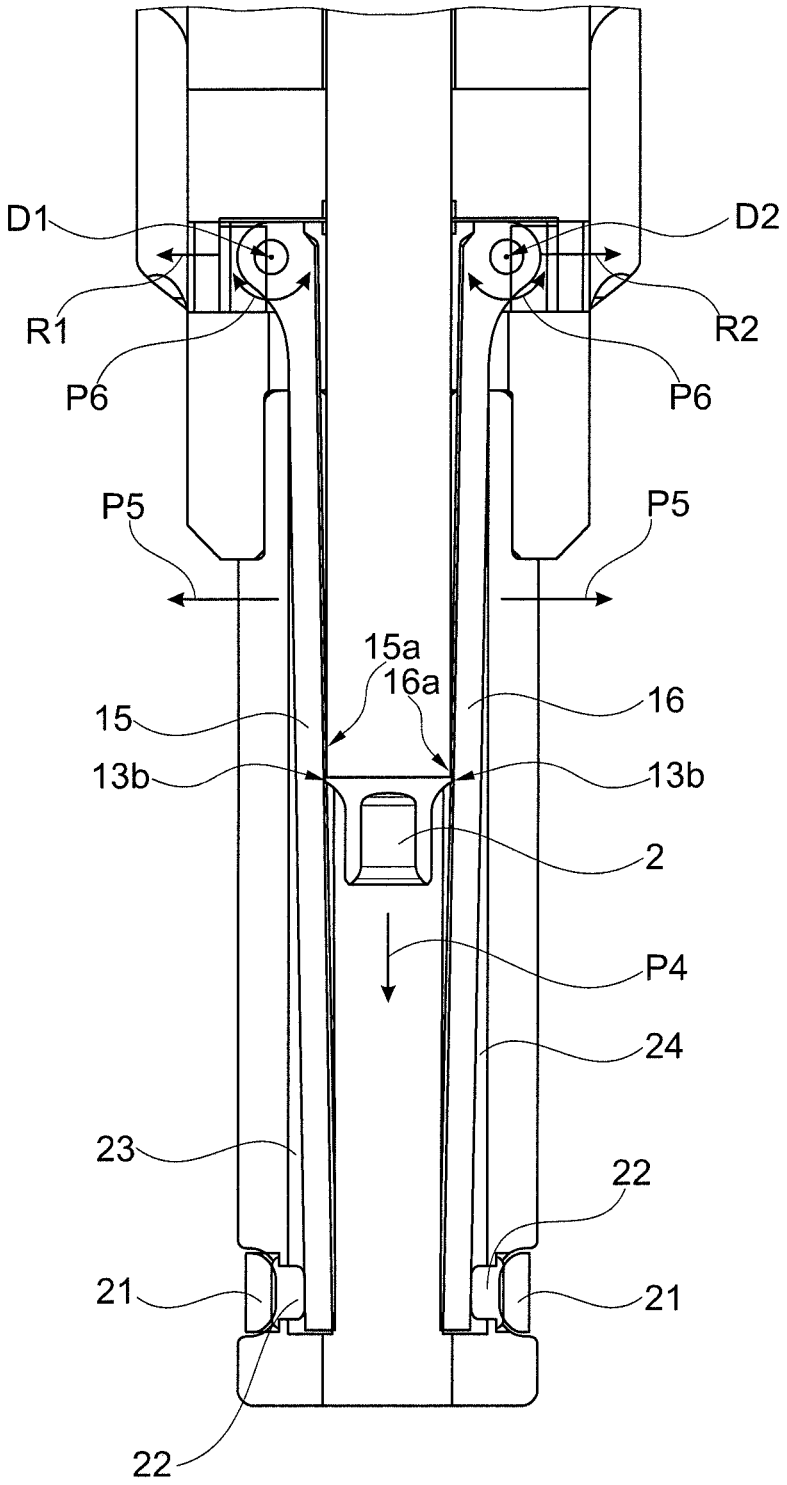
FIG. 4 shows a sectional representation according to FIG. 3 of the arrangement in a subsequent operating state with the punch moved partially forward.

The half-hollow self-pierce rivet 2 comes from a storage facility (not visible) for a plurality of half-hollow self-pierce rivets which is remote to the riveting tool 1 by means of a feed tube (not shown) which brings half-hollow self-pierce rivets to a feed channel 7 of the feeder 6. The half-hollow self-pierce rivets are conveyed in the direction P3 through the feed channel 7 into a rivet setting head 4 of the riveting tool 1. A punch of the riveting tool 1, which is realized as a rivet setting pin 5 which is movable to and fro in a linear manner according to the arrows P1 and P2 by means of a non-visible drive unit of the riveting tool 1, is situated in FIGS. 1 and 3 in a position fully moved back in the direction P2. FIG. 4 shows the rivet setting pin 5 in a partially extended position and FIG. 5 in a fully extended position with the half-hollow self-pierce rivet 2 located in front of it.

The half-hollow self-pierce rivet 2 is introduced from the storage facility into the rivet setting head 4 not in the axial direction or in the direction of the longitudinal axis L of the half-hollow self-pierce rivet 2 but in the transverse direction to the longitudinal axis L of the half-hollow self-pierce rivet 2 by the feeder 6. Thus, the half-hollow self-pierce rivet 2 is advantageously able to be shot directly under the rivet setting pin 5, it being possible to dispense with an otherwise necessary mechanism, for example a slide mechanism which has to turn the half-hollow self-pierce rivet 2 by 90 angular degrees before the punch is able to push the half-hollow self-pierce rivet 2 further in the direction P4 according to the alignment shown in FIG. 1 with a bottom surface of the rivet in the front.

The half-hollow self-pierce rivet 2 is conveyed in the direction P3, for example, by means of an air stream 8 or pneumatically, and is shot directly in under the rivet setting pin 5 or the end face thereof 5*a* and is aligned there in the presentation position 3 or is held in a positionally-fixed manner in the presentation region 3*a*.

The half-hollow self-pierce rivet 2 is sucked onto a stop 11 or onto an abutment contour 14 developed thereon as a result of applying a negative pressure p in a low pressure bore 10 and is held in a positionally-fixed position in the presentation position 3. At the same time, the sucked-in half-hollow self-pierce rivet 2 closes an opening 10*a* in the low pressure bore 10.

Figure 5:
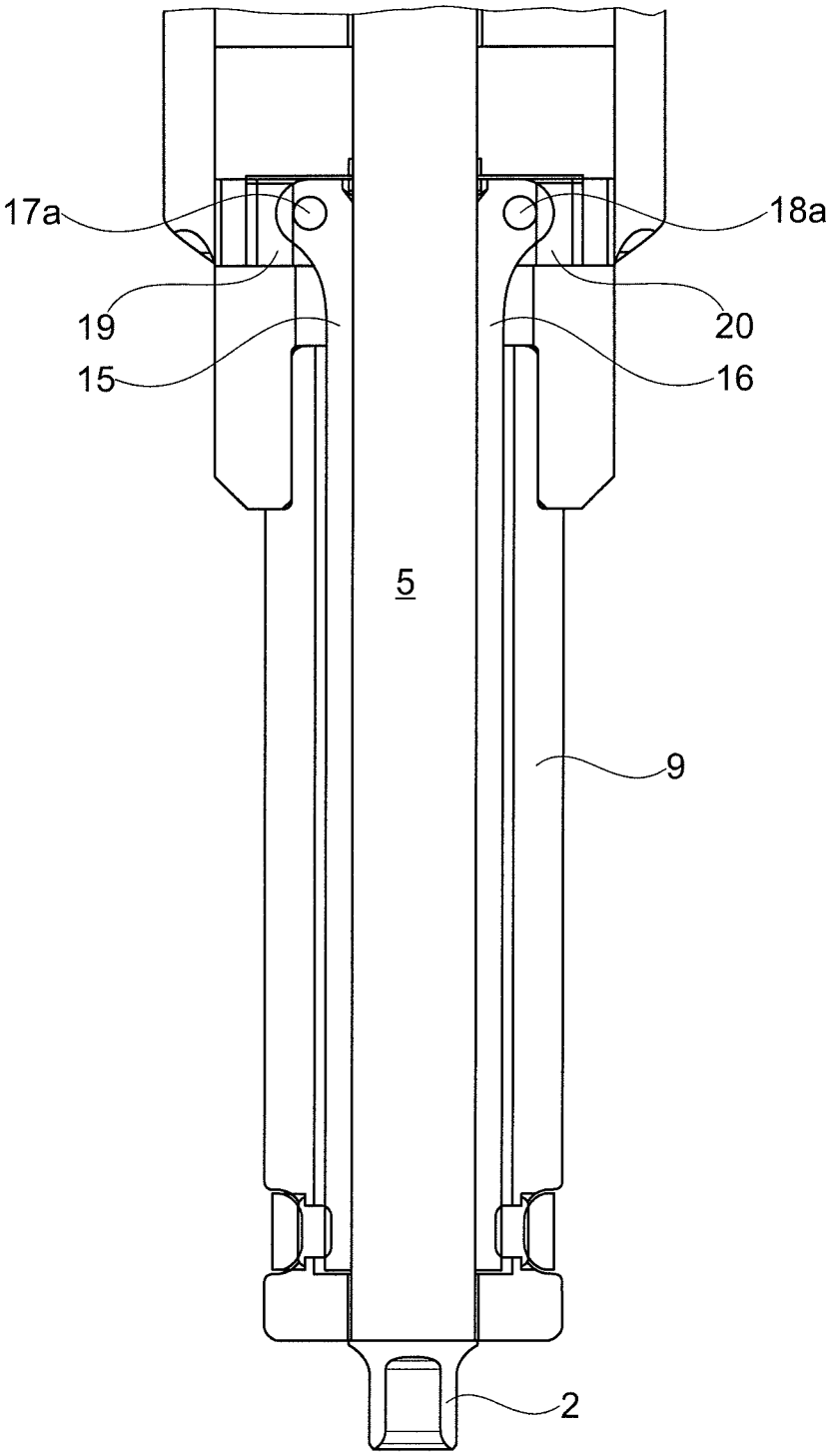
FIG. 5 shows a sectional representation according to FIGS. 3 and 4 of the arrangement in a further operating state with the punch extended to the maximum.

From the moved-back position of the rivet setting pin 5 according to FIGS. 1 and 3, when subsequently moving forward according to P1, the rivet setting pin entrains in each case one individual half-hollow self-pierce rivet out of the presentation position 3 shown for the half-hollow self-pierce rivet 2 in the presentation region 3*a* in the direction P4, by the end face 5*a*, which is developed as a flat, level surface, acting upon a head-side and also flat end face 2*a* of the half-hollow self-pierce rivet 2 and sliding the half-hollow self-pierce rivet 2 forward in the direction P4, which is illustrated by FIGS. 4 and 5. In this case, the half-hollow self-pierce rivet 2 is moved down from the presentation position 3 which, when viewed in the direction P3, is offset somewhat radially or according to FIG. 1 laterally to the longitudinal axis S of the rivet setting pin 5, until the longitudinal axis L of the half-hollow self-pierce rivet 2 and the longitudinal axis S of the rivet setting pin 5 are located on a common straight line. As a result of the end face 5*a* acting upon the end face 2*a*, the half-hollow self-pierce rivet 2, if the longitudinal axis L thereof is not aligned precisely parallel to the longitudinal axis S of the rivet setting pin 5, is moved into a precise parallel alignment of L and S such that the end face 5*a* abuts against the end face 2*a* in a parallel manner.

In the presentation position 3, the half-hollow self-pierce rivet 2 is situated with a rivet head 13, which merges on the outside into a shank 12 of the half-hollow self-pierce rivet 2 by means of a concave hollow molding 13*a*, in an at least almost positive-locking abutment against a correspondingly convexly formed section of the abutment contour 14 on the stop 11. Along the abutment contour 14, the half-hollow self-pierce rivet 2 is displaced in the first movement section out of the presentation position 3 or out of the presentation region 3*a* by the rivet setting pin 5 in opposition to P3 and in the direction P4 until the half-hollow self-pierce rivet 2 comes into holding contact with guide strips 15, 16. The half-hollow self-pierce rivet 2 is then slid further in a linear manner by the rivet setting pin 5 in the direction P4, which is illustrated in FIGS. 4 and 5.

In order to ensure that the half-hollow self-pierce rivet 2 is able to be moved forward out of the presentation position 3 by the forward-moving rivet setting pin 5 or comes into clamping contact centrally or in the middle between the guide strips 15, 16, the longitudinal axis of the stop 11 and consequently the wall forming the abutment contour 14 is slightly offset in the direction P3 with reference to the punch longitudinal axis S. Consequently, the half-hollow self-pierce rivet 2, correspondingly positioned in an offset manner, is moved by the rivet setting pin 5, which moves forward according to P1, slightly relatively in opposition to the direction P3, relative to the end face 5*a* of the rivet setting pin 5, that is to say somewhat back in opposition to the direction when arriving through the feed channel 7. Once the rivet head 13 with its hollow molding 13*a* has moved out of its at least almost positive-locking position on a section of the abutment contour 14 approximately corresponding to the form of the hollow molding 13*a*, the half-hollow self-pierce rivet 2 is guided further through a punch channel 9*a* in a hold-down clamp nose 9 or abutting against concave inside surfaces 15*a*, 16*a* of the guide strips 15, 16. Bore wall sections 9*b* of the punch channel 9*a* are present extensively adjacent the guide strips 15, 16 and offset outward by a few tenths of a millimeter radially to the inside surfaces 15*a*, 16*a*.

The sectional representations of the riveting tool 1 are produced in each case from sections through the longitudinal axis S of the rivet setting pin 5.

In an advantageous manner, the guide strips 15, 16 extend so far into the presentation region 3*a* by way of an upper section that the guide strips 15, 16 protrude clearly beyond a bottom edge 7*b* of the feed channel 7, in particular corresponding to an overall height 7*a* of the feed channel 7.

The rivet setting pin 5, in the state extended in the direction of a die unit of the riveting tool 1 (not shown) according to FIG. 5, is surrounded on the outside extensively over its entire length by the holding-down clamp, which is realized as a holding-down nose 9 and serves for the top-side fixing of the component section B which is supported on the bottom side on the matrix unit.

The transition from the lateral feeding of the half-hollow self-pierce rivet 2 according to P3 into the holding position 3 and from there further in the direction P4 is effected supported by the abutment contour 14 which provides a continuous pathway without interference contours and/or without component misalignments for the moved half-hollow self-pierce rivet 2.

In the presentation position 3 or in the presentation region 3*a* of the half-hollow self-pierce rivet 2, the half-hollow self-pierce rivet is, for example, at a spacing of a few tenths of a millimeter to sections of the guide strips 15 and 16, which is explained in more detail further below. The holding force on the half-hollow self-pierce rivet 2 as a result of the negative pressure p acting in the presentation position 3 breaks down as soon as the half-hollow self-pierce rivet 2 is urged minimally or slightly out of the presentation position 3 as a result of the influence of the rivet setting pin 5 which moves down according to P1. With the leaving of the presentation position 3, the inside surfaces 15*a*, 16*a* coming into contact with the half-hollow self-pierce rivet 2 take over the holding function or the guiding of the half-hollow self-pierce rivet 2. In this case, the half-hollow self-pierce rivet 2 is always moved or positioned in a defined aligned manner. The similar guide strips 15, 16 are advantageously realized as elongated longitudinal shells with the inside surfaces 15*a*, 16*a* thereof formed in a concave manner and are accommodated in the holding-down clamp nose 9.

As soon as the half-hollow self-pierce rivet 2 leaves the presentation position 3, the half-hollow self-pierce rivet 2 is held in a clamping manner between the sprung guide strips 15, 16 which, without a half-hollow self-pierce rivet 2 present, are prestressed and are positioned in a defined aligned manner.

The half-hollow self-pierce rivet 2, in this case, is held by the guide strips 15, 16 so as to press lightly against the outside. The guide strips 15, 16 are realized so as to be deflectable and adjustable outward. The guide strips 15, 16 provide a partial extension of a boundary of the feed channel 7. The guide strips 15, 16 are received in their upper end region or in the region of the presentation position 3 or in the region laterally of the presentation region 3*a* in each case by a linearly offsettable and guided rotational joint 17 or 18 with pivot axes D1 and D2 and are in each case under the prestressing of a respective leaf spring 19 or 20.

On the other end or in the bottom end region of the two guide strips 15, 16 the guide strips 15, 16 are resiliently prestressed. This is set up, for example, by a resilient element or a snap ring 21 which is placed around the guide strips 15, 16 on the outside. The snap ring 21 acts on the guide strips 15, 16 by, in each case, means of an intermediate element 22.

The guide strips 15, 16 are inserted into recessed cutouts in the longitudinal direction of the holding-down nose 9 or in suitably matched longitudinal grooves 23, 24 in the holding-down nose 9. The arrangement in the longitudinal grooves 23, 24 enables a slight oblique adjustment according to P6 and a resilient deflection movement of the guide strips 15, 16 according to R1 and R2 in the region of the rotational joints 17 and 18 when sliding a joining element through the punch channel 9*a* independently of the position of the half-hollow self-pierce rivet 2 along the punch channel 9*a*.

In the case of the half-hollow self-pierce rivet 2, an extensive circular ring-shaped edge 13*b* of the rivet head 13 comes into abutment contact with the respective concave inside surface 15*a*, or 16*a* of the guide strips 15, 16 when sliding through the punch channel 9*a* (see FIG. 4).

In this case, the guide strips 15, 16 deflect somewhat radially outward according to P5 or R1, R2 against the spring effect of the leaf springs 19, 20 or of the snap ring 21 or are adjusted somewhat temporarily about the pivot axes D1 and D2 according to P6.

The rotational joints 17, 18 which are guided linearly or radially according to R1, R2, enable the guide strips 15, 16 to be widened or opened for a funnel-like adjustment when the half-hollow self-pierce rivet 2 is slid through the punch channel 9*a* such that the half-hollow self-pierce rivet 2 is always clamped in front of the rivet setting head 5 and does not fall forward.

The rotational joints 17, 18 make it possible for the guide strips 15, 16 to be adjusted or pivoted from the moment at which the bottom sections of the guide strips 15, 16 open outward somewhat against the snap ring 21.

Bolts 17*a*, 18*a*, by way of which maximum positions or a fixed stop inward or toward one another is definable with reference to the radial position of the guide strips 15, 16, are included in the rotational joints 17, 18. For the maximum or stop positions of the guide strips 15, 16 viewed inward in the radial direction, the bolts 17*a*, 18*a* are guided transversely to the movement direction of the rivet setting pin 5 in each case in matched guide links 25. The guide link 25 is realized radially outward such that no stop is effective for the guide strips 15, 16 in order to exclude jamming of a joining element in a reliable manner.

In the state without a half-hollow self-pierce rivet 2 in the riveting tool 1, the guide strips 15, 16 are pressed inward by way of the leaf springs 19, 20 in a prestressed manner such that the protruding inside surfaces 15*a*, 16*a* form an aligned extension of a lateral wall of the feed channel 7 such that an arriving half-hollow self-pierce rivet 2, guided on both sides or laterally, reaches the presentation position 3 under the moved-back rivet setting pin 5.

The arrangement according to the invention consists in an advantageous manner of a few and simple components. Consequently, only a small installation space is necessary. In addition, comparatively simple structural elements such as the leaf springs 19, 20, the guide strips 15, 16 and the snap ring 21 are able to be used.

The guide strips 15, 16, with their respective bottom ends, are spaced somewhat from the free bottom end of the punch channel 9*a* or of the holding-down clamp nose 9, it being possible for the corresponding spacing between the ends of the guide strips 15, 16 and the bottom end of the holding-down clamp nose 9 to be a few millimeters. The spacing is in particular smaller than a length of the shortest joining element of all variants of joining elements which are processable by the apparatus such that even when the shortest of the joining or functional elements operable by the apparatus is being processed, it already sticks in the material layer or remains stuck before it is released by the guide strips 15, 16 or it loses contact with the guide strips. Consequently, a joining element is still held reliably by the guide strips 15, 16 even when the joining element protrudes out of the guide bore and is partially anchored in the component section, with the partial anchoring in the component section, a holding function which acts on the joining element by the guide strips 15, 16 is no longer necessary, as the joining element with the partial anchoring in the component section is already no longer able to tilt spatially in an undefined manner.

LIST OF REFERENCES

1 Rivet tool
2 Half-hollow self-pierce rivet
2*a* End face
3 Presentation position
3*a* Presentation region
4 Rivet setting head
5 Rivet setting pin
5*a* End face
6 Feeder
7 Feed channel
7*a* Feed channel height
7*b* Edge
8 Air stream
9 Holding-down clamp nose
9*a* Punch channel
9*b* Bore wall section
10 Low pressure bore
10*a* Opening
11 Stop
12 Shank
13 Rivet head
13*a* Hollow molding
13*b* Edge
14 Stop contour
15 Guide strip
15*a* Inside surface
16 Guide strip
16*a* Inside surface
17 Rotational joint
17*a* Bolt
18 Rotational joint
18*a* Bolt
19,20 Leaf spring
21 Snap ring
22 Intermediate element
23,24 Longitudinal groove
25 Guide link

The invention claimed is:

1. An apparatus for a tool for attaching a joining element or functional element to a component section, the apparatus comprising a presentation region and a feed line that are directly adjacent in a lateral direction, the tool including a punch that is linearly movable between retracted and extended positions on the tool, wherein the joining element or functional element is movable by means of the feed line, which has a contour, to a presentation position in the presentation region at an end face in front of the punch in the retracted position such that, during movement from the retracted position toward the extended position, the punch moves the joining element or functional element out of the presentation region of the apparatus and slides it into a guide line of the apparatus, the apparatus further comprising at least two positioning strips which extend along the guide line to position the joining element or functional element during the sliding movement through the guide line, wherein the at least two positioning strips have inside surfaces that extend beyond the guide line into the presentation region, such that each positioning strip is a single piece that protrudes into the presentation region at the end face in front of the punch, with the inside surfaces of the at least two positioning strips extending over the entire height of the presentation region and having a contour that correspondingly match the contour of the feed line that is directly adjacent to the presentation region so as to form an aligned extension of the feed line in the lateral direction, in such a manner that the joining element or functional element comes into contact with the at least two positioning strips when moving out of the presentation position on a path into the guide line and is held in a defined manner between the at least two positioning strips, and wherein the at least two positioning strips reach out of the guide line into the presentation region such that the at least two positioning strips are present laterally next to the joining element or functional element which is situated in the presentation position.

2. The apparatus as claimed in claim 1, wherein at least one of the at least two positioning strips is pivotable about a pivot axis in the presentation region.

3. The apparatus as claimed in claim 1, wherein the at least two positioning strips are mounted in a resilient manner in the presentation region.

4. The apparatus as claimed in claim 1, wherein the at least two positioning strips are pivotable in the presentation region about a pivot axis which is mounted in a resilient manner.

5. The apparatus as claimed in claim 1, wherein longitudinal ends of the at least two positioning strips, which are located opposite the longitudinal ends in the presentation region, are received in a resilient manner in a radial direction to a longitudinal axis of the guide line.

6. The apparatus as claimed in claim 1, wherein the at least two positioning strips extend over at least a substantial length of the guide line.

7. The apparatus as claimed in claim 1, wherein the at least two positioning strips are matched in such a manner so as to provide a holding force on the joining element or functional element as soon as the joining element or functional element moved out of the presentation position comes into contact with the at least two positioning strips, wherein a holding force acts on the joining element or functional element by way of the at least two positioning strips along the entire path that is then coverable along the at least two positioning strips by the joining element or functional element.

8. The apparatus as claimed in claim 1, wherein the at least two positioning strips include a contact side which is matched to an outside form of the joining element or functional element.

9. The apparatus as claimed in claim 1, further comprising a leaf spring arrangement in the presentation region, to provide a resilient bearing arrangement of the at least two positioning strips.

10. The apparatus as claimed in claim 1, further comprising an attachment part for the tool for attaching the joining element or functional element to the component section by means of the punch which is linearly movable between retracted and extended positions on the tool.

11. An apparatus for a tool for attaching a joining element or functional element to a component section, the apparatus comprising a presentation region and a feed line that are directly adjacent in a lateral direction, the tool including a punch that is linearly movable between retracted and extended positions on the tool, wherein the joining element or functional element is movable by means of the feed line, which has a contour, to a presentation position in the presentation region at an end face in front of the punch in the retracted position such that, during movement from the retracted position toward the extended position, the punch moves the joining element or functional element out of the presentation region of the apparatus and slides it into a guide line of the apparatus, wherein the guide line includes sections of a bore wall of a guide bore in a guide basic body, the apparatus further comprising at least two positioning strips present along the guide line for positioning the joining element or the functional element as it is slid through the guide line, wherein the at least two positioning strips have inside surfaces that extend beyond the guide line into the presentation region, such that each positioning strip is a single piece that protrudes into the presentation region at the end face in front of the punch, with the inside surfaces of the at least two positioning strips extending over the entire height of the presentation region and having a contour that correspondingly match the contour of the feed line that is directly adjacent to the presentation region so as to form an aligned extension of the feed line in the lateral direction, in such a manner that the joining element or functional element comes into contact with the at least two positioning strips when moving out of the presentation position on a path into the guide line and is held in a defined manner between the at least two positioning strips, and wherein the at least two positioning strips are matched to the bore wall such that the joining element or functional element is able to contact the sections of the bore wall as it slides through the guide line.

12. The apparatus as claimed in claim 11, wherein the at least two positioning strips and the guide basic body are matched to one another in such a manner that, with reference to a total area of a cross section of the guide line, the at least two positioning strips form a proportion of an area of the cross section that is at least 30% of the total area.

13. The apparatus as claimed in claim 12, wherein the at least two positioning strips form a proportion of the area of the cross section that is approximately 50% of the total area.

14. The apparatus as claimed in claim 12, wherein the at least two positioning strips form a proportion of the area of the cross section that is at least 60% of the total area.

* * * * *